US006739966B2

(12) United States Patent
DeRegge

(10) Patent No.: US 6,739,966 B2
(45) Date of Patent: May 25, 2004

(54) INTEGRATED AIR FLOW BOOTH AND METHODS

(75) Inventor: Karel J. DeRegge, Morrison, CO (US)

(73) Assignee: Garmat USA Inc., Englewood, CO (US)

( * ) Notice: Subject to any disclaimer, the term of this patent is extended or adjusted under 35 U.S.C. 154(b) by 0 days.

(21) Appl. No.: 10/371,482

(22) Filed: Feb. 21, 2003

(65) Prior Publication Data

US 2003/0143940 A1 Jul. 31, 2003

Related U.S. Application Data

(62) Division of application No. 09/735,784, filed on Feb. 26, 2001, now Pat. No. 6,533,654.

(51) Int. Cl.[7] ..... B05B 15/12
(52) U.S. Cl. ..... 454/52; 118/326
(58) Field of Search ..... 454/52; 118/326, 118/DIG. 7

(56) References Cited

U.S. PATENT DOCUMENTS

| | | | | |
|---|---|---|---|---|
| 1,745,908 A | | 2/1930 | Paasche | |
| 2,132,826 A | | 10/1938 | Ludwig | |
| 2,227,481 A | | 1/1941 | Bates | |
| 2,257,516 A | | 9/1941 | Roche, Jr. | |
| 2,831,550 A | | 4/1958 | Bub | |
| 3,566,585 A | | 3/1971 | Voloshen et al. | |
| 3,616,744 A | | 11/1971 | Jensen | |
| 3,813,856 A | | 6/1974 | Jensen | |
| 4,237,780 A | | 12/1980 | Truhan | |
| 4,245,551 A | | 1/1981 | Berkmann | |
| 4,261,256 A | * | 4/1981 | Joret | 454/51 |
| 4,285,270 A | | 8/1981 | Donahue | |
| 4,515,072 A | | 5/1985 | Crisp | |
| 4,770,118 A | | 9/1988 | Vohringer | |
| 4,827,903 A | | 5/1989 | Kim | |
| 4,874,412 A | | 10/1989 | Nowack | |
| 4,951,600 A | | 8/1990 | Soshi | |
| 5,063,835 A | * | 11/1991 | Rockx | 454/50 |
| 5,352,257 A | | 10/1994 | Powers | |
| 5,395,285 A | | 3/1995 | Milton | |
| 5,397,394 A | | 3/1995 | Orr | |
| 5,456,023 A | | 10/1995 | Farnan | |
| 5,473,844 A | * | 12/1995 | Martin | 118/326 |
| 5,855,509 A | * | 1/1999 | White et al. | 454/52 |
| 5,885,154 A | | 3/1999 | Napadow | |

FOREIGN PATENT DOCUMENTS

| | | |
|---|---|---|
| EP | 0006120 | 1/1980 |

OTHER PUBLICATIONS

Garmat® USA brochure—99700 Series Paint Booths.
Garmat® USA brochure—99877 Series Paint Booths.
Garmat® USA brochure—99800 Series Paint Booths.
Garmat® USA brochure—The Garmat® Quantum™.
Garmat® USA brochure—Closed Top Open Front Spray Booths 10400 & 10500 Series.
Garmat® USA brochure—Sanding Stations.
Garmat® USA brochure—Paint Mix Rooms.

* cited by examiner

*Primary Examiner*—Harold Joyce
(74) *Attorney, Agent, or Firm*—Townsend and Townsend and Crew LLP

(57) ABSTRACT

A spray booth comprises a housing having a ceiling and a set of walls that each have a bottom end and a top end, with the walls and the ceiling defining an interior. An air intake is disposed in the ceiling, and an exhaust outlet is disposed near the bottom end of one the walls. A circulation system is used to introduce air into the interior through the intake and to exhaust air through the outlet. Further, the air intake is configured to produce a airflow gradient within the interior such that the flow rate decreases in a direction toward the outlet and such that the airflow through the interior is in a generally downward direction.

13 Claims, 4 Drawing Sheets

INTEGRATED AIR FLOW BOOTH AND METHODS

This is a divisional application of U.S. patent application Ser. No. 09/735,784. filed Feb. 26, 2001 now U.S. Pat. No. 6,533,654.

BACKGROUND OF THE INVENTION

This invention relates generally to the field of spray booths, and in particular to spray booths which minimize the travel of particulate across on object being sprayed.

Many spray booths attempt to provide a clean environment to facilitate the spray of a material onto an object, such as the spray of paint or a clear coat finish onto an automobile. Such spray booths are configured to flow air through the interior of the booth to remove particulate, such as overspray, from the interior so that a smooth finish may be provided on the object. One technique is to use a cross flow of air which passes horizontally through the spray booth. Although relatively easy to achieve, such a techniques moves any overspray along the length of the object before being exhausted from the booth.

In an attempt to minimize travel of the overspray along the length of the object, some spray booths utilize a down draft where the air flows from the ceiling to the floor. A pit is incorporated into the floor to exhaust the air. Construction of such a pit can be expensive, especially if the spray booth is constructed over a concrete floor. Some attempts have been made to provide a hybrid between the horizontal flow design and the down draft design by flowing the air cross wise or diagonally through the booth. However, even with this design, the overspray is moved diagonally across the object.

Another disadvantage of conventional prior art spray booths is that they often require a significant amount of space. For example, fans, heaters, filters, and the like are often held within a separate module located adjacent the main spray booth housing. As such, the number of spray booths that may be located within a given space is limited.

Hence, the invention provides spray booths and techniques that are configured to minimize the travel of any particulate or overspray along the object being sprayed. The invention also provides spray booths that are cost effective and space effective, thereby making them commercially attractive.

SUMMARY OF THE INVENTION

The invention provides exemplary spray booths and methods for their use. In one embodiment, a spray booth comprises a housing that is constructed of a ceiling and a set of walls that each have a bottom end and a top end. The walls and the ceiling define an interior into which one or more objects that are to be sprayed may be placed. An air intake is incorporated into the ceiling, and an exhaust outlet is provided near the bottom end of one of the walls. A circulation system is employed to introduce air into the interior through the intake and to exhaust air through the outlet. Further, the air intake is configured to produce an airflow gradient within the interior such that the flow rate decreases in a direction toward the outlet. In this way, the airflow through the interior is flowed in a generally downward direction to minimize the travel of overspray or other particulate along the object. Further, by positioning the exhaust outlet near the bottom end, a near downdraft may be created without the creation of a pit, thereby reducing the cost of the spray booth.

In one aspect, the intake comprises a plurality of flow plates that each have different densities and/or sizes of openings to produce the gradient. For example, the flow plates which are furthest spaced from the outlet may include a higher density of openings so that greater airflow is achieved at this location. Alternatively, the intake may initially be generally open to the interior to provide the greatest flow, followed by one or more flow plates with the same or different densities of openings to produce the gradient. In another aspect, the housing has a front end and a rear end, and the intake is located at the front end and the outlet is located at the back end. In this way, the airflow is greatest at the ceiling level at the front end and decreases in the direction toward the back end.

In one particular aspect, the circulation system comprises at least one intake fan and at least one exhaust fan. Conveniently, the intake fan may be disposed within the ceiling to minimize the size of the spray booth. In another aspect, a heater may also be disposed in the ceiling upstream from the intake fan, thereby further reducing the overall size of the spray booth. In yet another aspect, a filter material may be disposed above the flow plates to filter the air prior to entry into the interior.

In still another aspect, a filter tower may be vertically positioned over the outlet so as to form one of the sides of the spray booth. The filter tower may include a set of generally vertically oriented filters. Such a configuration may be used to further reduce the overall size of the spray booth by incorporating the outlet and the outlet filters in a side of the spray booth. In another aspect, the spray booth may include an outlet duct, with the exhaust fan being positioned between the filter tower and the outlet duct, thereby further minimizing the size of the spray booth.

To further integrate the components of the spray booth into a single housing, the spray booth may include an inlet duct extending vertically from the ceiling. Further, a wrap around duct may be positioned between the inlet duct and the air intake, with the wrap around duct extending around a periphery of the ceiling. Still further, the ceiling may include a plenum to distribute intake air to the air intake.

The invention further provides a method for spraying an object. According to the method, a spray booth is provided that comprises a housing having a ceiling and a set of walls that each have a bottom end and a top end. Further, the walls and the ceiling define an interior. An air intake is incorporated into the ceiling and an exhaust outlet is disposed near the bottom end of one of the walls. Air is passed into the interior through the intake such that an airflow gradient is produced within the interior. The gradient is such that the flow rate decreases in a direction toward the outlet where the air is exhausted from the interior. In this way, the air passes through the interior in a generally downward direction. While the air is flowing through the interior, an object that is disposed within the interior is sprayed with a material with any particular or overspray being drawn down to the floor and then across to the outlet to minimize its travel along the object.

In one aspect, the intake comprises a plenum and a set of flow plates having different densities of openings. With such a configuration, the air is passed into the plenum to produce the airflow gradient within the interior. In another step, the air is filtered prior to passing into the interior. Optionally, the air may also be heated prior to entry into the interior.

In one step of the method, the air may be forced into the interior using an intake fan. In another aspect, the air is filtered after exiting through the exhaust outlet. In still another aspect, the object comprises an automobile that is sprayed with paint or an overcoat.

DESCRIPTION OF THE SPECIFIC EMBODIMENTS

The invention provides equipment and techniques to create an environment conducive to spraying various objects. For example, the invention provides spray booths which minimize the travel of overspray or other particulate along the object being sprayed. Also, the invention provides spray booths that are cost efficient to manufacture and which minimize space.

In one embodiment, spray booths are provided which create a near down draft environment by introducing air into the interior of the booth from the ceiling and then exhausting the air through an exhaust outlet near the floor. In one aspect, the air intake is located at one end of the spray booth, and the exhaust outlet is located at an opposite end. Another feature of such spray booths is the creation of an air flow gradient within the interior to facilitate the down draft conditions. More specifically, air flowing at lower flow rates enters the interior closer to the exhaust outlet than air flowing at a higher flow rate. This causes the introduced air to flow nearly vertically downward over the object and then along the floor until reaching the exhaust outlet. Advantageously, by providing the exhaust outlet near the floor, a down draft condition may be achieved without utilizing a floor pit to exhaust the air.

Depending on the material being sprayed, the exhaust air needs to be filtered. The invention provides a filter tower that may be vertically positioned over the exhaust outlet to filter the exhausted air. The filters in the tower are generally vertically oriented and the exhausted air is drawn up through the filters to filter the air. In this way, the exhaust outlet may be located near the floor while still permitting the exhausted air to be filtered.

Another feature of the spray booths of the invention is that they may be constructed as a single integrated unit. For example, any fans, heaters, filters, and the like may be incorporated into the spray booth housing. In this way, a separate console for housing such items is not needed, and the surface area required to hold the spray booth may be significantly reduced. For example, the spray booths of the invention may be configured such that three spray booths may fit within the same space normally occupied by two conventional spray booths.

The spray booths of the invention may be constructed in various sizes depending on the objects to be sprayed. Merely by way of example, objects that may be placed within such spray booths include vehicles, such as automobiles, trucks, trailers, and the like, furniture, aircraft, and the like. Further, such spray booths may be employed to spray a variety of materials including paints, finishes, stains, and the like.

Figure 1:
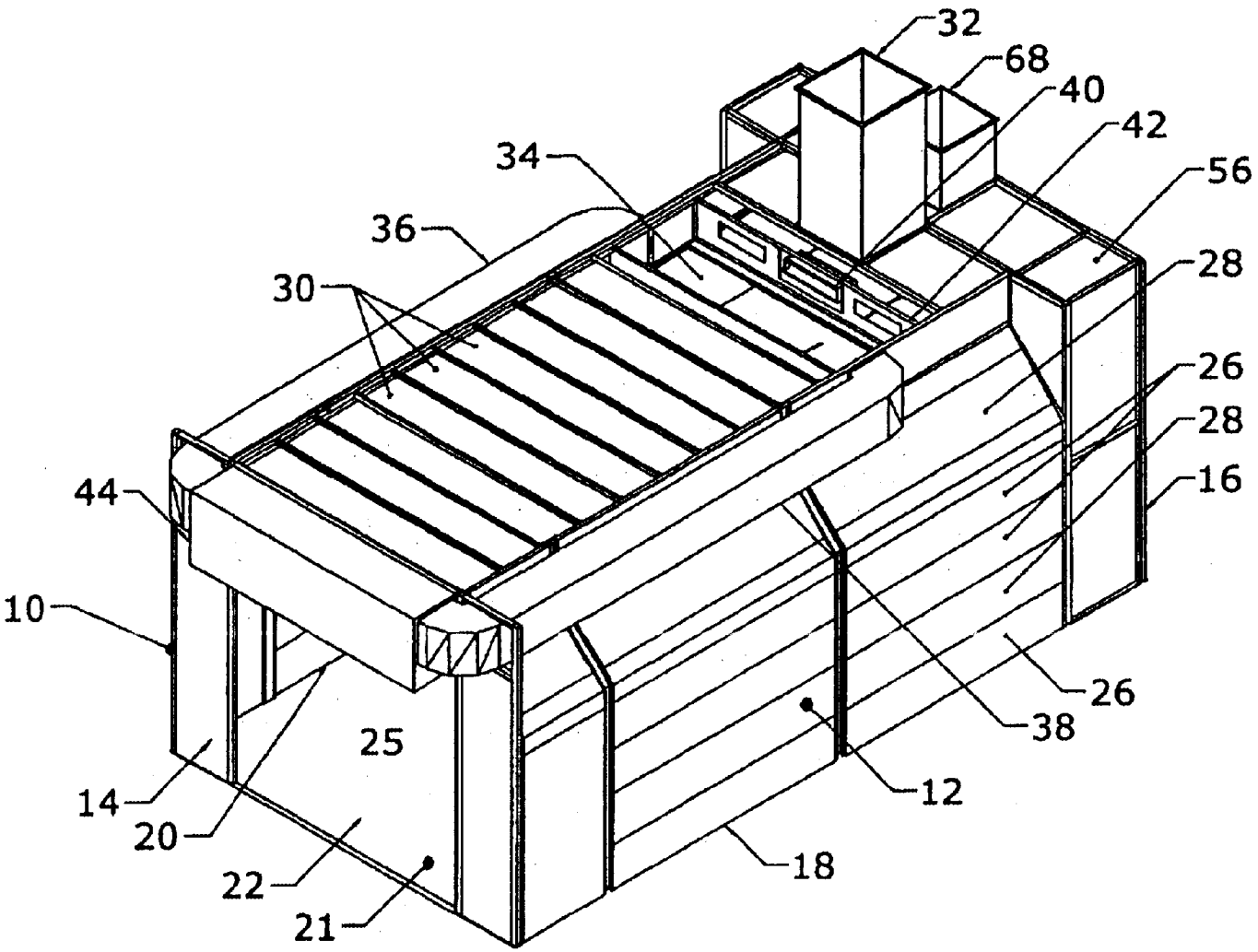
FIG. 1 is a perspective front view of one embodiment of a spray booth according to the invention.
Figure 2:
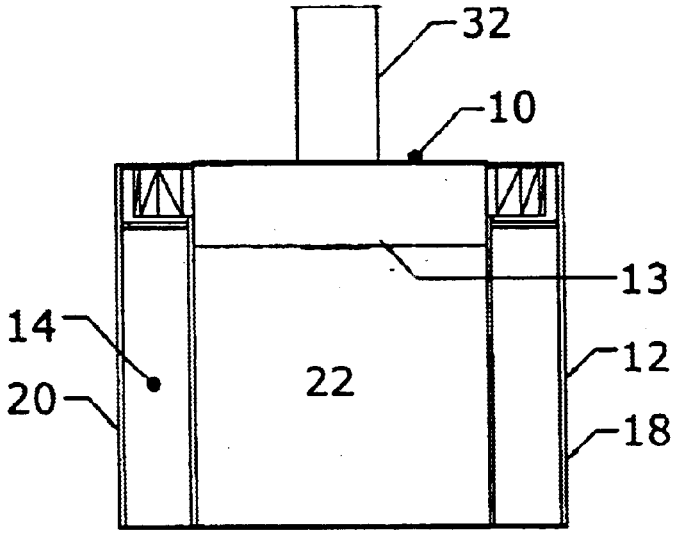
FIG. 2 is a front end view of the spray booth of FIG. 1.
Figure 3:
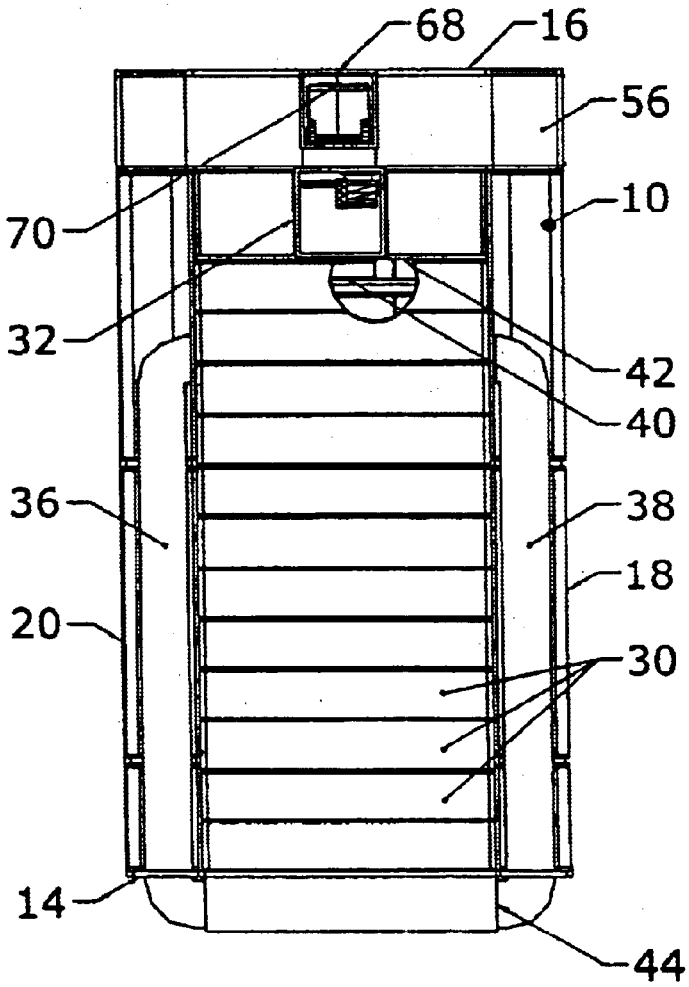
FIG. 3 is a top view of the spray booth of FIG. 1.

Referring now to FIGS. 1–3, one embodiment of a spray booth 10 will be described. Spray booth 10 comprises a housing 12 having a ceiling 13 (see FIG. 2), a front end 14, a back end 16 and side walls 18 and 20 which rest on a floor 21. Conveniently, front end 14 includes a doorway 22 and rear end 16 includes a doorway 24 (see FIG. 6) which are covered with doors (not shown) during a spraying operation. However, it will be appreciated that spray booth 10 may be constructed with only a single doorway. Spray booth 10 includes a generally open interior 25 for holding one or more objects which are to be sprayed.

Side walls 18 and 20 may conveniently be constructed from a plurality of steel panels 26 and may optionally include light panels 28 which include light fixtures to provide lighting within interior 25. Covering ceiling 13 are steel roof panels 30 (some of which have been removed for convenience of illustration) which form a roof.

Spray booth 10 may be constructed in a variety of sizes depending on the particular application. Merely by way of example, for use in spray painting automobiles, spray booth 10 may be constructed to have a length of about 24 feet 4 inches, a width of about 13 feet 8 inches and an interior height of about 10 feet. However, it will be appreciated that the invention is not intended to be limited to only this particular size.

To provide fresh air into interior 25, an intake duct 32 extends vertically from the roof of the booth. Typically, intake duct 32 will extend outside a building or structure housing spray booth 10 to provide ambient or outside air into spray booth 10. As the intake air passes through inlet duct 32, it passes into a plenum 34 which distributes the intake air into two wrap around ducts 36 and 38 which permit the intake air to be directed to front end 14 as shown by the arrows in FIG. 4.

Spray booth 10 may optionally include a direct fire burner 40 to heat the intake air prior to its entry into interior 25. A burner plate 42 is provided to hold direct fire burner 40 and to separate direct fire burner 40 from the interior of plenum 34. Conveniently, direct fire burner 40 may comprise a one million BTU direct gas fire burner.

Figure 4:
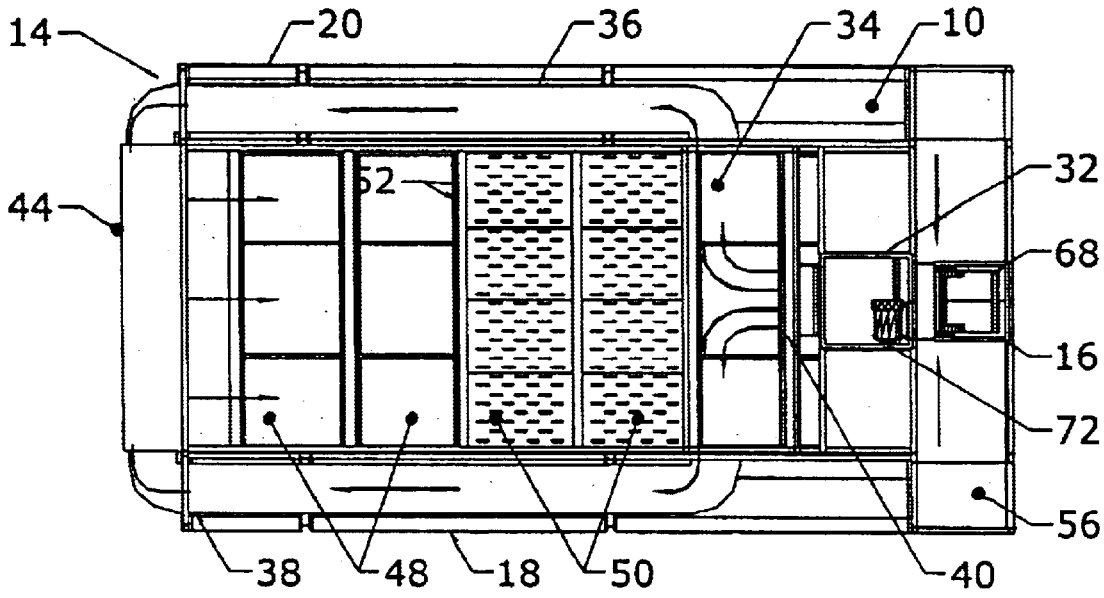
FIG. 4 illustrates the spray booth of FIG. 3 with the roof panels removed.
Figure 5:
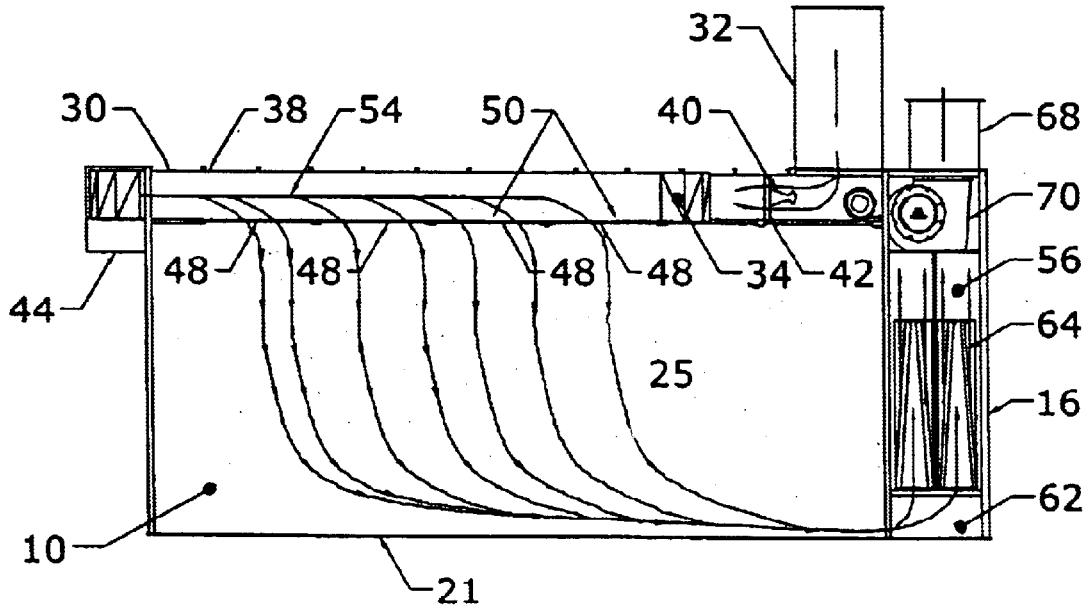
FIG. 5 is a cross sectional side view of the spray booth of FIG. 1 showing the air flow through the booth.

The intake air passing through ducts 36 and 38 passes into a common intake fan box 44. Although not shown, intake fan box 44 includes multiple intake fans that draw the intake air in through intake duct 32 and then through wrap around ducts 36 and 38 where the air enters into intake fan box 44 as previously described. Merely by way of example, intake fan box 44 may include three RDZ 280 model fans that are driven by 7½ horsepower, three-phase motors, commercially available from Baldor. As best shown in FIGS. 4 and 5, the intake air passes from intake fan box 44 into a distribution region 46 positioned between roof panels 30 and ceiling 13.

Ceiling 13 is constructed of a plurality of filter racks 48 for holding a filter material (not shown). Disposed above the two filter racks which are nearest back end 16 are balancing plates 50. Each balancing plate 50 includes a plurality of openings 52 to permit airflow through balancing plates 50. The density of openings 52 in balancing plates 50 may optionally increase in the direction toward back end 16.

The use of balancing plates 50 permits an airflow gradient to be achieved within interior 25 as illustrated by airflow arrows 54. As shown best in FIG. 5, the intake air initially entering distribution region 56 passes through the first two filter racks 48 at a relatively high flow rate. However, the intake air passing further through distribution region 46 must flow through filter racks 48 which reduces the flow rate as the intake air comes closer to back end 16. In this way, an airflow gradient is achieved within interior 25, with the airflow at the highest rate being nearest front end 14 and the airflow with the lowest flow rate being nearest back end 16. By configuring the airflow rates in this manner, the air entering interior 25 passes generally downward until reaching floor 21. The air flow then travels along floor 21 until reaching an exhaust filter tower 56. In this way, any particulate or overspray will travel in a downward direction to minimize its travel across any object within interior 25. More specifically, the increase in air speed at front end 14 is provided to force the air downward. As this air passes along floor 21, it occupies a certain volume. Hence, balancing plates 50 are employed to limit the amount of air entering at this location because of the accumulated volume of air along the portion of floor 21 that is below balancing plates 50. In this way, substantially all of the entering air moves in a downward direction until reaching the floor where it is drawn to exhaust filter tower 56 and exhausted from interior 25.

Figure 6:
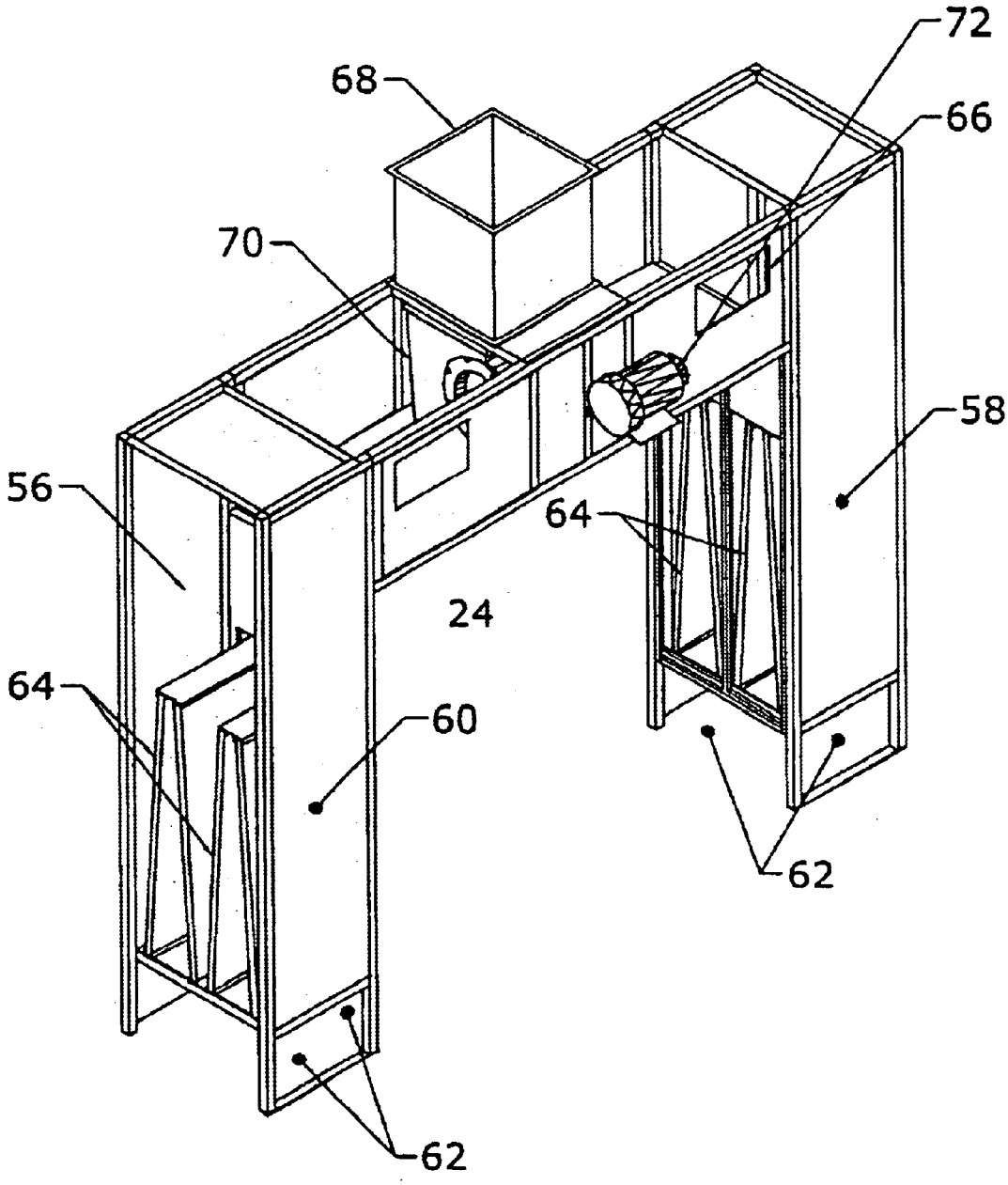
FIG. 6 is a perspective view of a filter tower of the spray booth of FIG. 1.

As best shown in FIGS. 5 and 6, exhaust filter tower 56 comprises a pair of filter towers 58 and 60 having exhaust openings 62 just above floor 21 to permit the air flowing through interior 25 to be exhausted into towers 58 and 60 as shown by the arrows in FIG. 5. Disposed above openings 62 are sets of filters 64 that are nearly vertically oriented. Although filters 64 are shown exposed in FIGS. 5 and 6, it will appreciated that appropriate steel panels will fully enclose filters 64 during operation. These panels may conveniently be removed to replace filters 64 when needed. Use of towers 58 and 60 is advantageous in that the exhausted air may be filtered while permitting opening 62 to be located at floor 21. In this way, a downdraft condition may be established within the interior 25 as previously described. Further, towers 58 and 60 permit filter 64 to be integrated into spray booth 10 to reduce the overall size of spray booth 10.

The exhausted air passing through filter 64 passes through dampers 66 and into an exhaust duct 68 where the exhausted air may be transferred to the environment. To assist in exhausting the air, exhaust filter tower 56 includes an exhaust fan 70 that is driven by a motor 72. Conveniently, exhaust fan 70 may comprise a RDZ 450 exhaust fan, and motor 72 may comprise a 7½ horsepower, three-phase motor, commercially available from Baldor. By using the intake fans in fan box 44 and exhaust fan 70, spray booth 10 may be configured to flow air through interior 25 at a rate of 10,000 cubic feet per minute.

Although not shown, a control panel may conveniently be attached anywhere on spray booth 10 and may include an electrical panel, a gas train for the direct fire burner, and the like. Further, a remote controller may be electrically coupled to the control panel to control operation of spray booth 10 remotely. Such a controller may include controls to control the lighting, fan speed, booth pressure, operation of the burner, interior temperature, air pressure, break timers, and the like.

One important aspect of spray booth 10 is that the intake fans, exhaust fans, burners and the like are all incorporated into a single housing. For example, as just described, the direct fire burner, intake fans and exhaust fan are located within the ceiling. In this way, the outer periphery of spray booth 10 may be greatly reduced. For example, spray booth 10 may be constructed such that three such spray booths may be placed within the same space previously required for only two conventional spray booths. In this way, more spray booths may be incorporated within a single facility. Further, the configuration of spray booth 10 provides essentially a downdraft flow within the interior without the use of an underground pit, thereby greatly reducing its cost to manufacture. At the same time, the drown draft condition is achieved to provide better results.

The invention has now been described in detail for purposes of clarity of understanding. However, it will be appreciated that certain changes and modifications may be practiced within the scope of the appended claims.

What is claimed is:

1. A method for spraying an object, the method comprising:

providing a spray booth comprising a housing having a ceiling and a set of walls that each have a bottom end and a top end, wherein the walls and the ceiling define an interior, an air intake in the ceiling and an exhaust outlet near the bottom end of one of the walls;

passing air into the interior through the intake such that an airflow gradient is produced within the interior, with the flow rate decreasing in a direction toward the outlet and with the air passing through the interior in a generally downward direction;

exhausting air from the interior through the exhaust outlet; and spraying an object that is disposed within the interior while the air is flowing through the interior;

wherein the intake comprises a plenum and a set of flow plates having different densities of openings, and further comprising passing the air into the plenum to produce the airflow gradient within the interior.

2. A method as in claim 1, further comprising filtering the air prior to passing into the interior.

3. A method as in claim 1, further comprising heating the air prior to passing the air into the interior.

4. A method as in claim 1, further comprising passing the air into the interior using an intake fan.

5. A method as in claim 1, further comprising filtering the air after exiting through the exhaust outlet.

6. A method as in claim 1, wherein the object comprises an automobile, and further comprising spraying the automobile with paint.

7. A method for spraying an object, the method comprising:

providing a spray booth comprising a housing having a ceiling, a pair of ends and a set of side walls that each have a bottom and a top, wherein each end has an opening that permits a vehicle to drive through the housing, and wherein the side walls and the ceiling define an interior, an air intake in the ceiling and an exhaust outlet on each of the side walls near the bottoms and near one of the openings;

passing air into the interior through the intake such that an airflow gradient is produced within the interior, with the flow rate decreasing in a direction toward the outlets and with the air passing through the interior in a generally downward direction;

exhausting air from the interior through the exhaust outlets; and spraying an object that is disposed within the interior while the air is flowing through the interior.

8. A method as in claim 7, wherein the intake comprises a plenum and a set of flow plates having different densities of openings, and further comprising passing the air into the plenum to produce the airflow gradient within the interior.

9. A method as in claim 7, further comprising filtering the air prior to passing into the interior.

10. A method as in claim 7, further comprising heating the air prior to passing the air into the interior.

11. A method as in claim 7, further comprising passing the air into the interior using an intake fan.

12. A method as in claim 7, further comprising filtering the air after exiting through the exhaust outlets.

13. A method as in claim 7, wherein the object comprises an automobile, and further comprising spraying the automobile with paint.

* * * * *